US005668080A

United States Patent [19]

Cove et al.

[11] Patent Number: 5,668,080

[45] Date of Patent: Sep. 16, 1997

[54] THERMALLY-RESPONSIVE RECORD MATERIAL

[75] Inventors: Michael Gerald Cove, Neenah; Mary Ellen Schulz, Greenville, both of Wis.

[73] Assignee: Appleton Papers Inc., Appleton, Wis.

[21] Appl. No.: 759,805

[22] Filed: Dec. 3, 1996

[51] Int. Cl.[6] ..... B41M 5/30

[52] U.S. Cl. ..... 503/209; 503/216; 503/217; 503/218; 503/220; 503/221

[58] Field of Search ..... 427/150–152; 503/208, 209, 216–218, 220, 221

[56] References Cited

U.S. PATENT DOCUMENTS

| | | | |
|---|---|---|---|
| 5,154,738 | 10/1992 | Armstrong | 55/67 |
| 5,180,709 | 1/1993 | Etzweiler et al. | 512/17 |
| 5,214,160 | 5/1993 | Etzweiler | 549/290 |
| 5,313,002 | 5/1994 | De Jeij et al. | 568/664 |
| 5,358,861 | 10/1994 | Markus et al. | 435/147 |
| 5,432,154 | 7/1995 | De Jeij et al. | 512/22 |
| 5,482,635 | 1/1996 | Behan et al. . | |

*Primary Examiner*—Bruce H. Hess

*Attorney, Agent, or Firm*—Benjamin Mieliulis

[57] ABSTRACT

A novel thermally-responsive record material is disclosed comprising a support having provided thereon in substantially contiguous relationship an election donating dye precursor and a compound of the formula

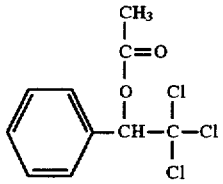

9 Claims, No Drawings

THERMALLY-RESPONSIVE RECORD MATERIAL

FIELD OF THE INVENTION

This invention relates to thermally-responsive record material. It more particularly relates to such record material in the form of sheets coated with color-forming systems comprising chromogenic material (electron-donating dye precursor) and acidic color developer material. This invention particularly concerns a thermally-responsive record material (thermal record material) capable of forming a non-reversible image resistant to face or erasure. The invention teaches a record material having improved image retention density.

DESCRIPTION OF RELATED ART

Thermally-responsive record material systems are well known in the art and are described in many patents, for example, U.S. Pat. Nos. 3,539,375; 3,674,535; 3,746,675; 4,151,748; 4,181,771; 4,246,318; 4,470,057 which are incorporated herein by reference. In these systems, basic chromogenic material and acidic color systems, basic chromogenic material and acidic color developer material are contained in a coating on a substrate which, when heated to a suitable temperature, melts or softens to permit said materials to react, melts or softens to permit said materials to react, thereby producing a colored mark.

Thermally-responsive record materials have characteristic thermal responses, desirably producing a colored image upon selective thermal exposure.

Some drawbacks of some thermally responsive record materials limiting utilization in certain environments and applications are the undesirable tendency of thermally responsive record materials upon forming an image to not retain that image in its original integrity over time or when the thermally responsive record material is handled or exposed to UV light or subjected to conditions of heat and humidity. The stability and intensity of the image formed by the thermally-responsive record material is of importance to the end user. A need for stable and faster imaging, high sensitivity paper is required by today's lower energy printing equipment.

A need exists to improve stability of thermal record materials to improve the archival capabilities of such record materials, and to enhance the environments in which such materials can be consistently utilized. Improvement in such record materials is needed to respond to the requirements of changing hardware particularly thermal print heads operating at lower energies.

The ability of a thermally-responsive record material to have improved imaging characteristics such as enhanced image stability or faster imaging would be an advance in the art and of commercial significance. It is an object of the present invention to disclose a thermally-responsive record material having improved image stability.

SUMMARY OF THE INVENTION

The present invention is a novel thermally-responsive record material beating a thermally-sensitive color-forming composition comprising an electron-donating dye precursor and an acidic developer material in contiguous relationship, whereby the melting or sublimation of either material produces a change in color by reaction between the two, and a benzyl acetate of the formula

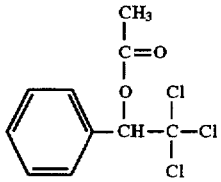

(I)

DETAILED DESCRIPTION

Description of Preferred Embodiments

The present invention is a novel thermally-responsive record material bearing a thermally-sensitive color-forming composition comprising an electron-donating dye precursor and an acidic developer material in contiguous relationship, whereby the melting or sublimation of either material produces a change in color by reaction between the two, and a benzyl acetate of the formula

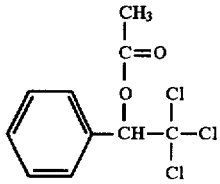

and a suitable binder.

The thermally-responsive record material of the invention has the unexpected and remarkable properties of being capable of forming a stable non-reversible high density image upon thermal contact.

The benzyl acetate of the invention desirably functions as a sensitizer facilitating reaction between the mark-forming components yielding a more intense image at lowered temperatures or faster imaging.

While the benzyl acetate used in the invention is a known material described in such patents as U.S. Pat. Nos. 5,180,709 and 5,214,160 it has heretofore been used in the context of perfumes. Surprisingly the material has remarkable properties beneficial to manufacture of improved thermal record material according to the invention. Benzyl acetate according to formula 1 is commercially available from chemical specialty manufacturers such as Aldrich Chemical, Milwaukee, Wis., alternatively would be able to be synthesized by one skilled in the art. The benzyl acetate can be named as 7-(trichloromethyl)-benzyl acetate. This material can be synthesized from benzyl acetate for example by condensing benzyl acetate with a trichloromethyl alcohol. Other synthetic routes would be apparent to the artisan having skill in the synthetic arts. The invention resides in the surprising combination of this material within a thermally imaged record material.

The invention comprises a thermally sensitive color-forming composition comprising electron donating dye precursor and acidic developer material, a benzyl acetate of formula I and binder material. The unexpected feature of this composition is that the inclusion of the compound of formula I facilitates the color-forming reaction resulting in a more intense image or faster imaging by image formation at lower temperature. The record material according to the invention has a non-reversible image in that it is substantially non-reversible under the action of heat. The coating of the record material of the invention is basically a dewatered solid at ambient temperature and differs from reversible solvent liquid based compositions such as taught by Kito et at., in U.S. Pat. Nos. 4,720,301 and 4,732,810 which erase upon exposure to elevated temperature from 20° C. to 50° C. The image herein formed is non-reversible at such temperature. The color-forming composition (or system) of the record material of this invention comprises chromogenic material (electron-donating dye precursor) in its substantially colorless state, acidic developer material such as, for example, phenolic compounds. The color-forming system relies upon melting, softening, or subliming one or more of the components to achieve reactive, color-producing contact.

The record material includes a substrate or support material which is generally in sheet form. For purposes of this invention, sheets can be referred to as support members and are understood to also means webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The gist of this invention resides in the color-forming composition coated on the substrate. The kind or type of substrate material is not critical.

The components of the color-forming system are in substantially a contiguous relationship, substantially homogeneously distributed throughout the coated layer or layers of material deposited on the substrate.

The term substantially contiguous relationship is understood to mean that the color-forming components are positioned in sufficient proximity such that upon melting, softening or subliming one or more of the components, a reactive color forming contact between the components is achieved. As is readily apparent to the person of ordinary skill in this art, these reactive components accordingly can be in the same coated layer or layers, or isolated or positioned in separate layers. In other words, one component can be positioned in the first layer, and reactive or sensitizer components or the benzyl acetate or acidic developer positioned in a subsequent layer or layers. The coating can optionally be applied to all of the substrate or spot printed on a certain portion. All such arrangements are understood herein as being substantially contiguous.

In manufacturing the record material, a coating composition is prepared which includes a fine dispersion of the components of the color-forming system, polymeric binder material, surface active agents and other additives in an aqueous coating medium. The composition can additionally contain inert pigments, such as clay, talc, aluminum hydroxide, calcined kaolin clay and calcium carbonate; synthetic pigments, such as urea-formaldehyde resin pigments; natural waxes such as Carnuba wax; synthetic waxes; lubricants such as zinc stearate; wetting agents; defoamers, and antioxidants. Other sensitizers can also be included. These sensitizers for example, can include acetoacet-o-toluidine, phenyl-1-hydroxy-2-naphthoate, 1,2-diphenoxyethane, and p-benzylbiphenyl.

The color-forming system components are substantially insoluble in the dispersion vehicle (preferably water) and are ground to an individual average particle size of between about 1 micron to about 10 microns, preferably about 1–3 microns. The polymeric binder material is substantially vehicle soluble although latexes are also eligible in some instances. Preferred water soluble binders include polyvinyl alcohol, hydroxy ethyl-cellulose, methylcellulose, methylhydroxypropylcellulose, starch, modified starches, gelatin and the like. Eligible latex materials include polyacrylates, styrene-butadiene-rubber latexes, polyvinylacetates, polystyrene, and the like. The polymeric binder is used to protect the coated materials from brushing and handling forces occasioned by storage and use of thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible election-donating dye precursors are chromogenic compounds, such as the phthalide, leucauramine and fluoran compounds, for use in the color-forming system are well known color-forming compounds. Examples of the compounds include Crystal Violet Lactone (3,3-bis(4-dimethylaminophenyl)-6-dimethylaminophthalide, U.S. Pat. No. Re. 23,024); phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, the U.S. Pat. Nos. 3,624,107; 3,627,78; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilino-flouran (U.S. Pat. No. 4,510,513) also known as 3-dibutylamino-6-methyl-7-anilino-fluoran; 3-dibutylamino-7-(2-chloroanilino) fluoran; 3-(N-ethyl-N-tetrahydrofurfurylamino)-6-methyl-7-3,5'6-tris(dimethylamino)spiro[9H-fluorene-9, 1'(3'H)-isobenzofuran]-3'-one; 7-(1-ethyl-2-methylindol-3-yl)-7-(4-diethylamino-2-ethoxyphenyl)-5,7-dihydrofuro[3,4-b] pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-dihydrofuro[3,4-b] pyridin-5-one; 3-diethylamino-7,8-benzofluoran; 3,3-bis(1-ethyl-2-methylindol-3-yl)phthalide; 3-diethylamino-7-anilinofluoran; 3-diethylamino-7-benzylaminofluoran; 3'-phenyl-7-dibenzylarnino-2,2'-spirodi-[2H-1-benzopyran] and mixtures of any of the following.

Examples of eligible acidic developer material include the compounds listed in U.S. Pat. No. 3,539,375 as phenolic reactive material, particularly the monophenols and diphenols. Eligible acidic developer material also includes, without being considered as limiting, the following compounds which may be used individual or in mixtures: 4,4'-isopropylidinediphenol (Bisphenol A); p-hydroxybenzaldehyde; p-hydroxybenzophenone; p-hydroxypropiophenone; 2,4-dihydroxybenzophenon; 1,1-bis(4-hydroxyphenyl)cyclohexane; salicyanilide; 4-hydroxy-2-methylacetophenone; 2-acetylbenzoic acid; m-hydroxyacetanilide; p-hydroxyacetanilide; 2,4-dihydroxyacetophenone; 4-hydroxy-4'-methylbenzophenone; 4,4'-dihydroxybenzophenone; 2,2-bis(4-hydroxyphenyl)-4-methylpentane; benzyl 4-hydroxyphenyl ketone; 2,2-bis(4-hydroxyphenyl)-5-methylhexane; ethyl-4,4-bis(4-hydroxyphenyl)-pentanoate; isopropyl-4,4-bis (4-hydroxyphenyl) pentanoate; methyl-4, 4-bis (4-hydroxyphenyl) pentanoate; alkyl-4,4-bis (4-hydroxyphenyl) pentanoate; 3,3-bis (4-hydroxyphenyl)-pentane; 4,4-bis(4-hydroxyphenyl) -heptane; 2,2-bis(4-hydroxyphenyl)-1-phenylpropane; 2,2-bis(4-hydroxyphenyl) butane; 2,2'-methylene-bis (4-ethyl-6-tertiarybutyl phenol); 4-hydroxycoumarin; 7-hydroxy-4-methylcoumarin; 2,2'-methylene-bis(4-octyl phenol); 4,4'-sulfonyldiphenol; 4,4'-thiobis(6-tertiarybutyl-m-cresol); methyl-p-hydroxybenzoate; n-propyl-p-hydroxybenzoate; benzyl-p-hydroxybenzoate. Preferred among these are the phenolic developer compounds. More preferred among the phenol compounds are 4,4'-isopropylindinediphenol, ethyl-4,4-bis(4-hydroxyphenyl)pentanoate, n-propyle-4,4-bis(4-hydroxyphenyl)pentanoate, isopropyl-4,4-bis (4-hydroxyphenyl) pentanoate, methyl 4,4-bis(4-hydroxyphenyl) pentanoate, 2,2-bis (4-hydroxyphenyl)-4-methylpentane, p-hydroxybenzophenone, 2,4-dihydroxybenzophenone, 1,1-bis(4-hydroxyphenyl) cyclohexane, and benzyl-p-hydroxybenzoate. Acid compounds of other kind and types are eligible.

Examples of such other compounds are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like. Some of the polymers and minerals do not melt but undergo color reaction on fusion of the chromogen.

The following examples are given to illustrate some of the features of the present and should not be considered as limiting. In these examples all parts or proportions are by weight and all measurement are in the metric system, unless otherwise stated.

In all examples illustrated the present invention a dispersion of a particular system component was prepared by milling the component in an aqueous solution of the binder until a particle size of between about 1 micron and 10 microns was achieved. The milling was accomplished in an attritor or other suitable milling device. The desired average particle size was about 1–3 microns in each dispersion.

Although the examples illustrate the invention using 2,2bis (4-hydroxyphenyl)-4-methylpentane as the acidic developer material, the invention is readily practiced using any of the eligible acidic developer materials listed above.

The thermally-responsive sheets were made by making separate dispersions of chromogenic material, acidic material and the compound of formula I. The dispersions were mixed in the desired ratios and applied to a support with a wire wound rod and dried. The dispersions were mixed in the desired ratios and applied to a support with a wire wound rod and dried. Other materials such as fillers, antioxidants, lubricants and waxes can be added if desired. The sheets may be calendered to improve smoothness.

The thermal images are measured used a McBeth RD-922 densitometer. The densitometer is calibrated such that 0.08 indicates pure white and 1.79 a fully saturated black image.

Dispersions can be prepared in a quickie mill, attritor and small media mill. (Nopco NDW is a sulfonated castor oil produced by Nopco Chemical Company. Surfynol 104 is a di-tertiary acetylene glycol surface active agent produced by Air Products and Chemicals, Inc. Water-soluble polymers other than polyvinyl alcohol (PVA) may be used to prepare the dispersions.

| Dispersion A - Chromogenic Material is N-102 3-diethylamino-6-methyl-7-anilinofluoran | |
|---|---|
| | Parts |
| N-102 | 94.95 |
| PVA, Vinoll 205 20% in Water | 81.00 |
| Nopco NDW | 0.23 |
| Surfynol 104 | 1.13 |
| Water | 122.69 |
| **Dispersion B - Acidic Material is AP-5 2,2-bis(4-hydroxyphenyl)-4-methylpentane** | |
| AP-5 | 102.00 |
| PVA, Vinol 205 20% in Water | 87.00 |
| Nopco NDW | 0.12 |
| Surfynol 104 | 0.48 |
| Water | 153.26 |
| **Dispersion C1 - Sensitizer is ROSA 7-(trichloromethyl)-benzyl acetate** | |
| ROSA | 89.25 |
| PVA, vinol 205, 20% in water | 76.13 |
| Nopco NDW | 0.11 |
| Surfynol 104 | 0.42 |
| Water | 134.09 |
| **Dispersion C2 - Sensitizer is DPE 1,2-diphenoxyethane** | |
| DPE | 89.25 |
| PVA, Vinol 205 20% in Water | 76.13 |
| Nopco NDW | 0.11 |
| Surfynol 104 | 0.42 |
| Water | 134.09 |
| **Dispersion C3 - Sensitizer is DMT dimethylterephthalate** | |
| DMT | 89.25 |
| PVA, vinol 205, 20% in water | 76.13 |
| Nopco NDW | 0.11 |
| Surfynol 104 | 0.42 |
| Water | 134.09 |
| **Dispersion C4 - Sensitizer is DBO di-benzyl oxalate** | |
| DBO | 89.25 |
| PVA, vinol 205, 20% in water | 76.13 |
| Nopco NDW | 0.11 |
| Surfynol 104 | 0.42 |
| Water | 134.09 |
| **Dispersion C5 - Sensitizer is PHNT phenyl-1-hydroxy-2-naphthoate** | |
| PHNT | 89.25 |
| PVA, vinol 205, 20% in water | 76.13 |
| Nopco NDW | 0.11 |
| Surfynol 104 | 0.42 |
| Water | 134.09 |
| **Dispersion C6 - Sensitizer is PBBP p-benzyl biphenyl** | |
| PBBP | 89.25 |
| PVA, vinol 205, 20% in water | 76.13 |
| Nopco NDW | 0.11 |
| Surfynol 104 | 0.42 |
| Water | 134.09 |

Test Formulation

| Material | Parts |
|---|---|
| Example 1 | |
| Dispersion A (N102) | 0.75 |
| Dispersion B (AP-5) | 2.69 |
| Dispersion C1 (ROSA) | 2.69 |
| Filler | 1.12 |
| PVA, Vinol 325, 10% | 4.87 |
| Zinc stearate, 23.3% | 1.03 |
| Water | 6.85 |
| Example 2 | |

-continued

| | |
|---|---|
| (comparative) | |
| Dispersion A (N102) | 0.75 |
| Dispersion B (AP-5) | 2.69 |
| Dispersion C2 (DPE) | 2.69 |
| Filler | 1.12 |
| PVA, Vinol 325, 10% | 4.87 |
| Zinc stearate, 23.3% | 1.03 |
| Water | 6.85 |
| Example 3 (comparative) | |
| Dispersion A (N102) | 0.75 |
| Dispersion B (AP-5) | 2.69 |
| Dispersion C3 (DMT) | 2.69 |
| Filler | 1.12 |
| PVA, Vinol 325, 10% | 4.87 |
| Zinc stearate, 23.3% | 1.03 |
| Water | 6.85 |
| Example 4 (comparative) | |
| Dispersion A (N102) | 0.75 |
| Dispersion B (AP-5) | 2.69 |
| Dispersion C4 (DBO) | 2.69 |
| Filler | 1.12 |
| PVA, Vinol 325, 10% | 4.87 |
| Zinc stearate, 23.3% | 1.03 |
| Water | 6.85 |
| Example 5 (comparative) | |
| Dispersion A (N102) | 0.75 |
| Dispersion B (AP-5) | 2.69 |
| Dispersion C5 (PHNT) | 2.69 |
| Filler | 1.12 |
| PVA, Vinol 325, 10% | 4.87 |
| Zinc stearate, 23.3% | 1.03 |
| Water | 6.85 |
| Example 6 (comparative) | |
| Dispersion A (N102) | 0.75 |
| Dispersion B (AP-5) | 2.69 |
| Dispersion C6 (PBBP) | 2.69 |
| Filler | 1.12 |
| PVA, Vinol 325, 10% | 4.87 |
| Zinc stearate, 23.3% | 1.03 |
| Water | 6.85 |

| | 60 C. 24 hr | 40 C.-90% RH 10 Day | UV Light 10 Day | Fingerprint 10 Day |
|---|---|---|---|---|
| Example 1 | −16.00% | −17.00% | −10.00% | −31.00% |
| Example 2 | −20.00% | −19.00% | −15.00% | −35.00% |
| Example 3 | −18.51% | −29.10% | −21.66% | −29.89% |
| Example 4 | −26.00% | −22.00% | −22.73% | −31.08% |
| Example 5 | −20.64% | −23.64% | −21.11% | −30.18% |
| Example 6 | −19.06% | −26.00% | −21.84% | −29.87% |

Note: The lower % change the more stable 60C-24 hour

Image stability test was completed by imaging the comparative example samples and Example 1 sample. The imaged samples were read on a McBeth RD-922 Densitometer. Samples were then stored in a 60 C. degrees oven for 24 hours. They were then reread in the same area read prior to exposure. % change in relative reflectance was then calculated.

40C-90% R.H.—10 day test

Image stability test was completed by imaging the comparative example samples and Example 1 sample with a facsimile machine. The imaged samples were read on a McBeth RD-922 Densitometer. Samples were then stored in a 40 C.-90% relative humidity chamber for 10 days. They were then reread in the same area read prior to exposure. % change in relative reflectance was then calculated.

UV Light—10 day

Image stability test was completed by imaging the comparative example samples and Example 1 sample with a facsimile machine. The imaged samples were read on a McBeth RD-922 Densitometer. Samples were then stored in a UV Light room (1500 lux) for 10 days. They were then reread in the same area read prior to exposure. % change in relative reflectance was then calculated.

Fingerprint—10 day

Image stability test was completed by imaging the comparative example samples and Example 1 sample with a facsimile machine. The imaged samples were read on a McBeth Densitometer. Samples were then exposed to fingerprints (5 second contact). After 10 days they were reread in the same area read prior to exposure. % change in relative reflectance was then calculated.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes can be made by those skilled in the art without departing from the spirit and scope of the invention.

What is claimed is:

1. A thermally responsive record material comprising a support having provided thereon in substantially contiguous relationship an electron-donating dye precursor, an acidic developer material, a compound of the formula

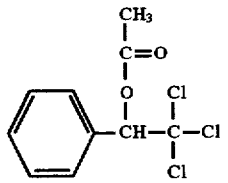

and a suitable binder therefor.

2. The record material of claim 1 in which the acidic developer material is a phenol compound.

3. The record material of claim 2 in which the phenol compound is selected from the group consisting of 4,4'-isopropylindinediphenol, ethyl-4,4-bis(4-hydroxyphenyl) pentanoate, n-propyl-4,4-bis(4-hydroxyphenyl)pentanoate, methyl-4,4-bis (4-hydroxyphenyl)-pentanoate, allyl-4,4-bis (hydroxyphenyl) pentanoate, 2,2-bis(4-hydroxyphenyl)-4-methylpentane, p-hydroxybenzophenone, 2,4-dihydroxybenzophenone, 1,1-bis(4-hydroxyphenyl) cyclohexane, 2,2-bis(4-hydroxyphenyl)-5-methylhexane, benzyl-p-hydroxybenzoate, and mixtures thereof.

4. The record material of claim 2 in which the phenol compound is 2,2-bis(4-hydroxyphenyl)-4-methylpentane.

5. The record material of claim 2 in which the phenol compound is benzyl-p-hydroxybenzoate.

6. The record material of claim 1 in which the electron donating dye precursor is selected from the group consisting of 3-diethylamino-6-methyl-7-anilinofluoran; 7-(1-ethyl-2-methyl-indol-3-yl)-7-(4-diethylamino-2-ethoxy-phenyl)-5,7-dihydrofur 3[3,4-b]pyridin-5-one; 3-diethylamino-7-(2-chloroanilino)fluoran; 3-(N-methylcyclohexylamino)-6-methyl-7-anilinofluoran; 7-(1-octyl-2-methyl-indol-3-yl)-7-(4-diethylamino-2-ethoxyphenyl)-5,7-dihydrofuro[3,4-b] pyridin-5-one; 3'-phenyl-7-dibenzylamino-2,2'-spiro-di[2H-1-benzopyran]; 3-dibutylamino-6-methyl-7-anilinofluoran; 3-(N-ethyl-N-tetrahydrofurfurylamino)-6-methyl-7-anilinofluoran; 3-dibutylamino-7-(2-chloranilino)fluoran;

3,3-bis(4-dimethylaminophenyl)-6-diemethylaminophthalide; 7-(1-ethyl-2-methyl-indol-3-yl)-7-(4-diethylamino-2-ethoxyphenyl)-5,7-dihydrofuro,[3,4-b] pyridine-5-one; 3,5', 6-tris (dimethylamino) spiro[9H-fluorene-9,1'(3'H)isobenzofuran]3'-one, and mixtures thereof.

7. The record material of claim 1 comprising in addition a sensitizer.

8. The record material of claim 7 wherein the sensitizer is selected from 1,2-diphenoxyethane, acetoacet-o-toluedine, dimethyl terephthalate, p-benzylbiphenyl, and phenyl-1-hydroxy-2-naphthoate.

9. A thermally responsive record material comprising a support having provided thereon in substantially contiguous relationship an electro-donating dye precursor, an acidic developer material, 7-(trichloromethyl)benzyl acetate, and a suitable binder therefore.

* * * * *